US007584635B2

(12) United States Patent
Gan et al.

(10) Patent No.: US 7,584,635 B2
(45) Date of Patent: Sep. 8, 2009

(54) MULTIFUNCTIONAL LOCK

(75) Inventors: Vincent Gan, Suzhou (CN); Yang Shen, Suzhou (CN)

(73) Assignee: Malafon Electronic (Suzhou) Co., Ltd., Suzhou (CN)

( * ) Notice: Subject to any disclaimer, the term of this patent is extended or adjusted under 35 U.S.C. 154(b) by 0 days.

(21) Appl. No.: 12/065,807

(22) PCT Filed: Jul. 20, 2006

(86) PCT No.: PCT/CN2006/001781

§ 371 (c)(1),
(2), (4) Date: Aug. 7, 2008

(87) PCT Pub. No.: WO2007/028308

PCT Pub. Date: Mar. 15, 2007

(65) Prior Publication Data

US 2008/0314102 A1 Dec. 25, 2008

(30) Foreign Application Priority Data

Sep. 9, 2005 (CN) ..... 2005 2 0075364 U
Jan. 25, 2006 (CN) ..... 2006 2 0068971 U

(51) Int. Cl.
*E05B 29/06* (2006.01)

(52) U.S. Cl. ..... 70/338; 70/383; 70/384; 70/492; 70/495

(58) Field of Classification Search ..... 70/383–385, 70/337–343, 492–496, 358, 368, 378, DIG. 22, 70/DIG. 75
See application file for complete search history.

(56) References Cited

U.S. PATENT DOCUMENTS

| | | | | |
|---|---|---|---|---|
| 3,667,262 | A * | 6/1972 | Hill | 70/384 |
| 3,990,282 | A * | 11/1976 | Sorum | 70/495 |
| 4,376,382 | A * | 3/1983 | Raymond et al. | 70/338 |
| 4,942,749 | A * | 7/1990 | Rabinow | 70/495 |
| 6,119,495 | A * | 9/2000 | Loreti | 70/340 |
| 7,007,528 | B2 * | 3/2006 | Chong et al. | 70/492 |
| 7,047,778 | B2 * | 5/2006 | Dimig et al. | 70/495 |
| 7,114,357 | B2 * | 10/2006 | Armstrong et al. | 70/492 |
| 7,162,901 | B2 * | 1/2007 | Williams | 70/493 |
| 7,424,815 | B1 * | 9/2008 | Pagnoncelli | 70/340 |
| 7,448,239 | B1 * | 11/2008 | Huang et al. | 70/360 |

(Continued)

FOREIGN PATENT DOCUMENTS

CN 2670535 Y 1/2005

(Continued)

*Primary Examiner*—Lloyd A Gall
(74) *Attorney, Agent, or Firm*—Alston & Bird LLP

(57) ABSTRACT

A multifunctional lock comprises a lock shell (1), a lock bar (3), movable tooth pieces (4), a support (5) for sliding blocks, sliding blocks (6) and a guide slot unit (8) for the insertion of a key. Wherein, an elastic element is provided between the lock bar and the support, the sliding blocks at least partially extend into the keyway of the unit. When the lock is unlocked, a projection of the unit has two operating positions, in one of which the projection is received into the cut of the shell and the upper teeth of the tooth pieces disengage from the bottom teeth of the sliding blocks, in another it is out of the cut and the upper teeth engage with the bottom teeth. The key of the lock can be changed many times.

7 Claims, 9 Drawing Sheets

A–A

U.S. PATENT DOCUMENTS

| | | | | |
|---|---|---|---|---|
| 7,448,240 | B1 * | 11/2008 | Huang et al. | 70/492 |
| 7,526,935 | B2 * | 5/2009 | Huang et al. | 70/360 |
| 2005/0016234 | A1 | 1/2005 | Strader et al. | |
| 2007/0101782 | A1 * | 5/2007 | Shen | 70/495 |

FOREIGN PATENT DOCUMENTS

| | | |
|---|---|---|
| EP | 1 411 192 A1 | 4/2004 |
| JP | 2000160888 | 6/2000 |

* cited by examiner

MULTIFUNCTIONAL LOCK

CROSS REFERENCE TO RELATED APPLICATIONS

This application is a 35 U.S.C. 371 national phase application of International Application No. PCT/CN2006/001781, filed Jul. 20, 2006, which International Application was published by the International Bureau in Chinese on Mar. 15, 2007, and claims priority to Chinese Patent Application No. 200520075364.2, filed Sep. 9, 2005, and Chinese Patent Application No. 200620068971.0, filed Jan. 25, 2006, each of which is incorporated herein by reference in its entirety.

TECHNICAL FIELD

The present utility model relates to a multifunctional lock, and in particular, to a multifunctional lock which allows the key to be changed many times.

BACKGROUND

China Patent No. 200320123249.4 discloses a lock which allows the key to be changed, wherein the original key can be removed at any position of the rotation of the lock core and changed by a new key in the unlocked condition, thus causing a potential security hazard.

SUMMARY OF THE INVENTION

It's the object of the present utility model to provide a multifunctional lock which allows the key to be changed many times and has no potential security hazard.

To accomplish the abovementioned object, the technical solution employed by the present utility model comprises: a multifunctional lock which includes a lock shell, and a lock core provided inside the lock shell, wherein said lock core includes a lock core body rotatable with said lock shell, a key bar provided slidably on said lock core body, a support for sliding blocks provided slidably on said lock core body, a plurality of sliding blocks provided slidably on said support for sliding blocks, and a plurality of tooth pieces provided slidably with respect to said lock core body, a lock bar slot to receive said lock bar is opened on said lock shell, each of said tooth pieces is provided with a recess on one side thereof and a plurality of upper teeth extending downwards on the other side thereof, each of said sliding blocks is provided with lower teeth extending upwards, a first elastic element is provided between each of said sliding blocks and its corresponding lock core body, said lock bar has two operating positions, in the first operating position of which, namely in locked condition, said lock bar is received into the said lock bar slot, and in the second operating position, namely in unlocked condition, said lock bar is out of said lock bar slot and is received into the recess on each of the tooth pieces, a second elastic element is provided between said lock bar and said support for sliding blocks, a unit linked to the support for sliding blocks is provided on one side of said support for sliding blocks, a keyway is provided in the unit, said sliding blocks at least partially extend into said keyway, said unit is provided with a projection thereon, a cut to receive said projection is provided on said lock shell, when the lock is unlocked said projection has two operating positions, in the first operating position of which said projection is received into said cut and said upper teeth disengage from said lower teeth, in the second position the said projection is out of said cut and said upper teeth engage with said lower teeth.

A guide slope is provided on the side wall of said lock bar slot.

A guide slope is provided on side wall of said cut.

Said cut is located in a position counterclockwise rotated from 10° to 360° relative to said lock bar slot.

Said lock bar is of elongated strip shape.

Said lock bar has teeth-like structure on the side facing the said tooth pieces and said tooth pieces has a plurality of recesses on one side thereof so that when the lock bar is in the second operating position, the teeth-like structure on said lock bar is received into the plurality of recesses on said tooth pieces.

With the application of the technical solution described above, the present utility model has the following advantages over the prior art: in the solution, the tooth pieces engage with the sliding blocks for most of the time during the rotation of lock core, and only when the lock core is rotated into the proper position where the projection on the unit is settled into the cut on the lock shell and because of the of the second elastic element the support for sliding blocks moves downwards with the unit, and the sliding blocks placed on the support for sliding blocks disengage from the tooth pieces initially engaged therewith, at this time the original key can be removed and changed into a new key, thus eliminating the potential security hazard.

As an improvement of the present utility model, two sets of tooth pieces and sliding blocks comprising said tooth pieces, sliding blocks and the first elastic element are symmetrically provided on said support for sliding blocks respectively with the sliding blocks in the two sets extending from opposite sides of the said keyway into the keyway respectively so that the key inserted into the keyway is able to have key tooth on both sides, which greatly increases the number of key tooth combination. A plurality of common pins which corresponds to the pin slot 13 on the side of the key can also be provided in the direction which is perpendicular to the direction of the keyway 23 within the unit 8.

As another improvement of the present utility model, there are at least two teeth-like structures on the side of said key bar facing the said tooth pieces, said tooth pieces have at least three recesses on one side, and the teeth-like structures on said key bar are inserted into the plurality of recesses on said tooth pieces when the said key bar is in the second operating position. In this way, there is a plurality of keys capable of opening a lock with such a key bar.

Wherein: 1 indicates a lock shell; 2 indicates a lock core; 3 indicates a lock bar; 4 indicates tooth pieces; 5 indicates a support for sliding blocks; 6 indicates sliding blocks; 7 indicates a first elastic element; 8 indicates a unit; 9 indicates a second elastic element; 10 indicates a key; 11 indicates a lock bar slot; 12 indicates a key tooth; 13 indicates a pin slot; 14 indicates an organized lock bar; 15 indicates organized tooth pieces; 16 indicates a cut; 17 indicates upper teeth; 18 indicates bottom teeth; 19 indicates a projection of the sliding blocks; 20 indicates a recess, 21 indicates a projection; 22 indicates a lock core body; 23 indicates a keyway; and 24 indicates a teeth-like structure.

DESCRIPTION OF THE EMBODIMENTS

Figure 2:
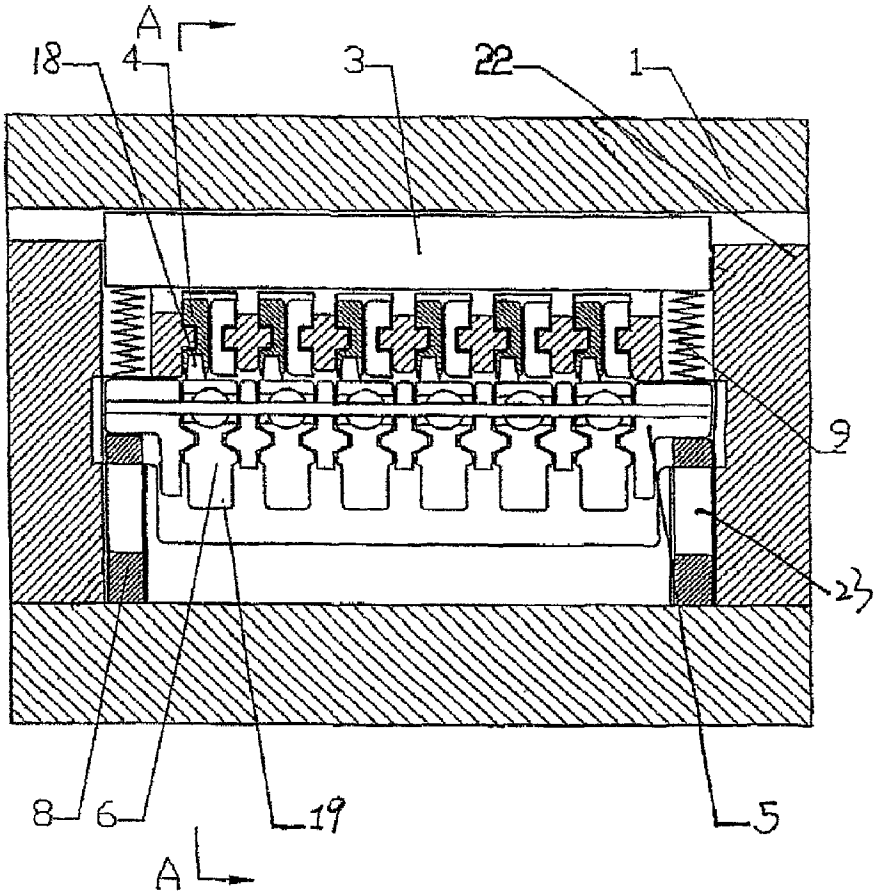
FIG. 2 is the cross-sectional view of the present utility model in the locked condition.
Figure 1:
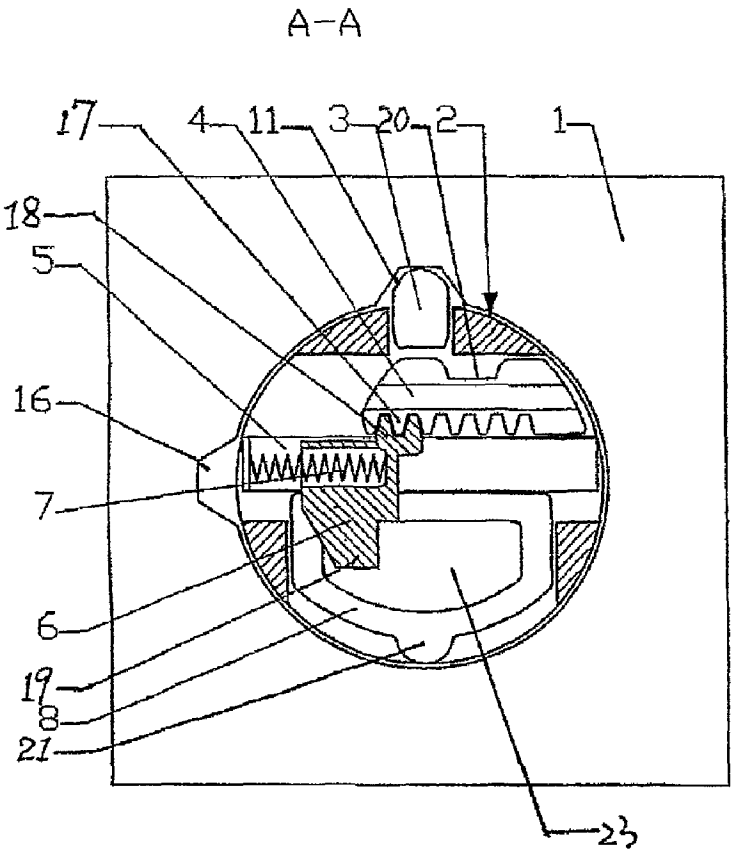
FIG. 1 is the cross-sectional view of the present utility model taken from the line A-A in FIG. 2.

Now with reference to FIGS. 1 and 2, a multifunctional lock comprises a lock shell 1, and a lock core 2 provided inside the lock shell 1, wherein said lock core 2 includes a lock core body 22 rotatable with respect to said lock shell 1, a key bar 3 provided slidably on said lock core body 22, a support 5 for sliding blocks provided slidably on said lock core body 22, a plurality of toothed sliding blocks 6 provided slidably on the said support 5 for sliding blocks, and a plurality of tooth pieces 4 provided slidably with respect to said lock core body 22, a lock bar slot 11 to receive said lock bar 3 is opened on the said lock shell 1, each of said tooth pieces 4 is provided with a recess 20 on one side thereof and a plurality of upper teeth 17 extending downwards on the other side, each of said sliding blocks 6 is provided with lower teeth 18 extending upwards, a first elastic element 7 is provided between each of said sliding blocks 6 and its corresponding lock core body 22, said lock bar 3 has two operating positions, in the first operating position of which, namely in locked condition, said lock bar 3 is received into said lock bar slot 11, and in the second operating position, namely in unlocked condition, said lock bar 3 is out of said lock bar slot 11 and is received into the recess 20 on each of the tooth pieces 4, characterized in that: a second elastic element 9 is provided between said lock bar 3 and said support 5 for sliding blocks, a unit 8 linked to the support 5 for sliding blocks is provided on one side of said support 5 for sliding blocks, a keyway 23 is provided in the unit 8, said sliding blocks 6 at least partially extends into said keyway 23, said unit 8 is provided with a projection 21 thereon, a cut 16 to receive the said projection 21 is provided on said lock shell 1, when the lock is unlocked said projection 21 has two operating positions, in the first operating position of which said projection 21 is received into said cut 16 and said upper teeth 17 disengage from said lower teeth 18, in the second position said projection 21 is out of said cut 16 and said upper teeth 17 engage with said lower teeth 18. A guide slope is provided on side wall of said lock bar slot 11. A guide slope is provided on the side wall of said cut 16. Two sets of tooth pieces and sliding blocks comprising said tooth pieces 4, toothed sliding blocks 6 and the first elastic element 7 are symmetrically provided on said support 5 for sliding blocks respectively with the toothed sliding blocks 6 in the two sets extending from opposite sides of said keyway 23 into the keyway 23 respectively. Said cut 16 is located in a position counterclockwise rotated from 88° to 92° relative to said lock bar slot 11. Said lock bar 3 is of elongated strip shape.

When the lock needs to be locked, the lock bar 3 is pushed by the second spring body 9 into the lock bar slot 11 on the lock shell 1 and prevented by the upper portion of the tooth pieces 4 from moving downwards so that the key bar 3 is in the first operating position wherein the lock core 2 is unable to rotate with respect to the lock shell 1, that is, being locked.

Figure 4:
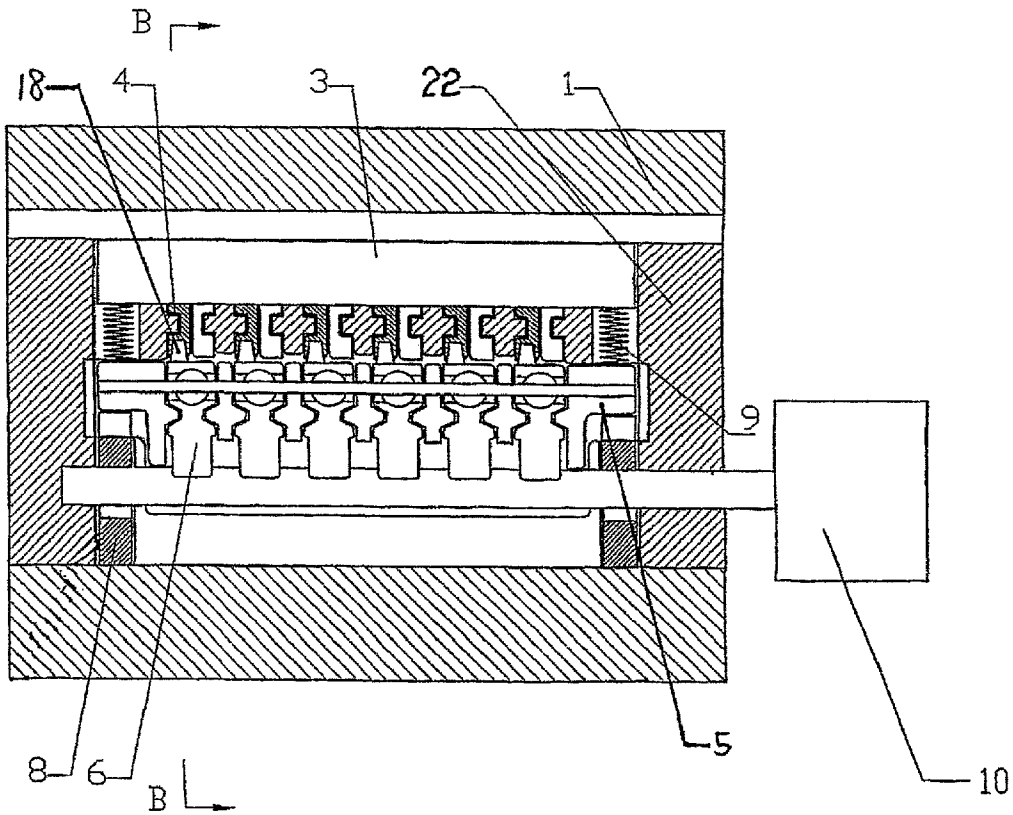
FIG. 4 is the cross-sectional view of the present utility model in the unlocked condition.
Figure 3:
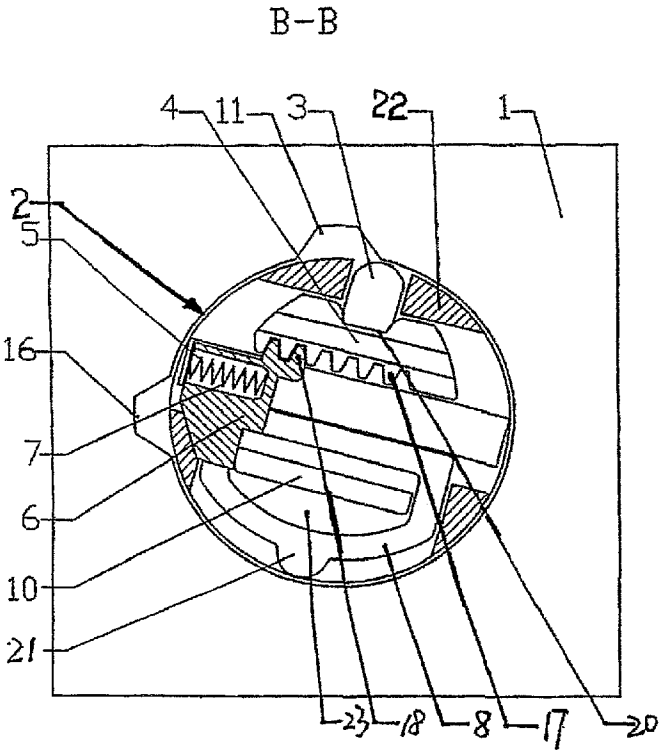
FIG. 3 is the cross-sectional view of the present utility model taken from the line B-B in FIG. 4.

With respect to FIGS. 3 and 4, the key 10 is inserted into unit 8 through the keyway 23, wherein the key tooth 12 thereon pushes the projection 19 on the sliding blocks 6 and enables the plurality of the toothed sliding blocks 6 to move with the plurality of the tooth pieces 4 engaged therewith and stop in a proper position where the recess on each of the tooth pieces 4 is aligned with the key bar 3 to form a recess body. At this point, the key bar 3 settles into the said recess body under the effect of gravity and is contracted when the lock core 2 is rotated. Now the key bar 3 is in the second operating position where the lock core 2 can be rotated, that is, being unlocked.

Figure 6:
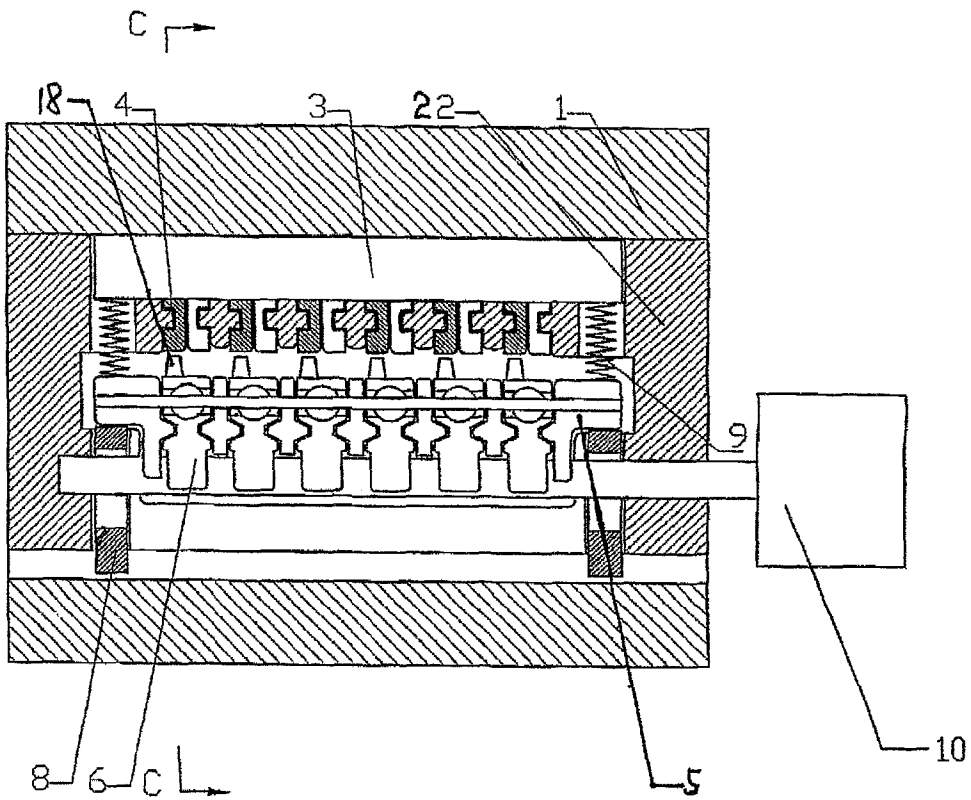
FIG. 6 is the cross-sectional view of the present utility model in which the key is ready for changing.
Figure 5:
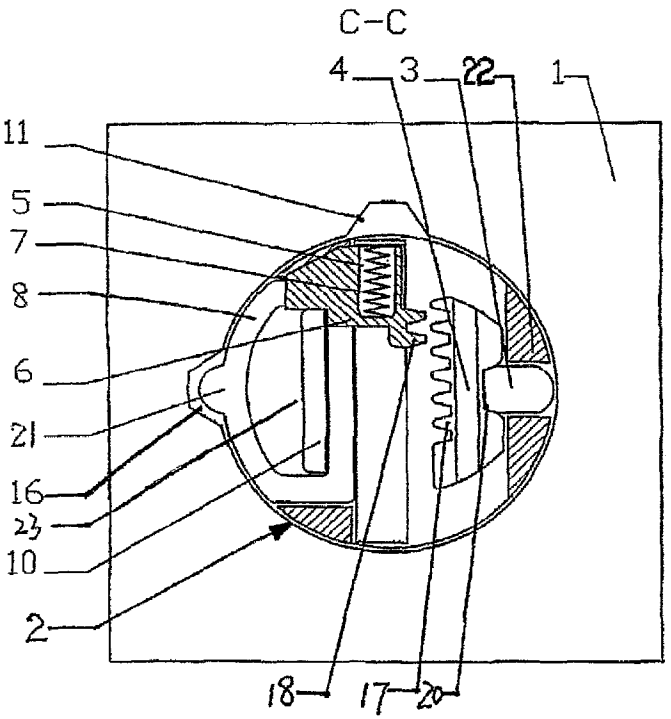
FIG. 5 is the cross-sectional view of the present utility model taken from the line C-C in FIG. 6.
Figure 8:
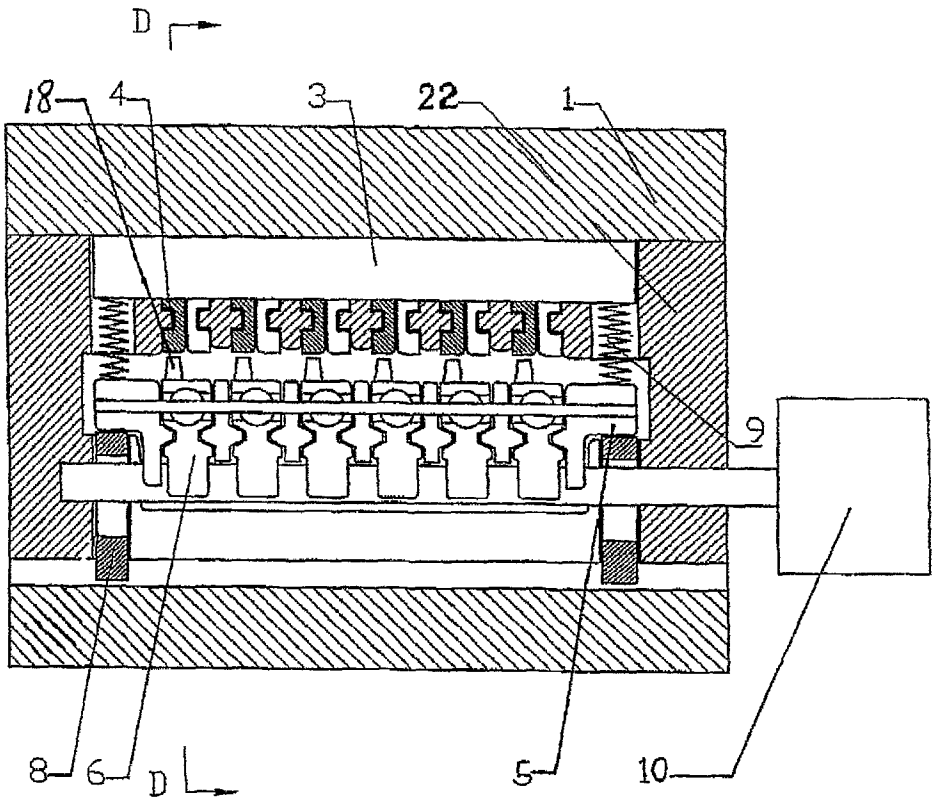
FIG. 8 is the cross-sectional view of the present utility model with the key changing.
Figure 7:
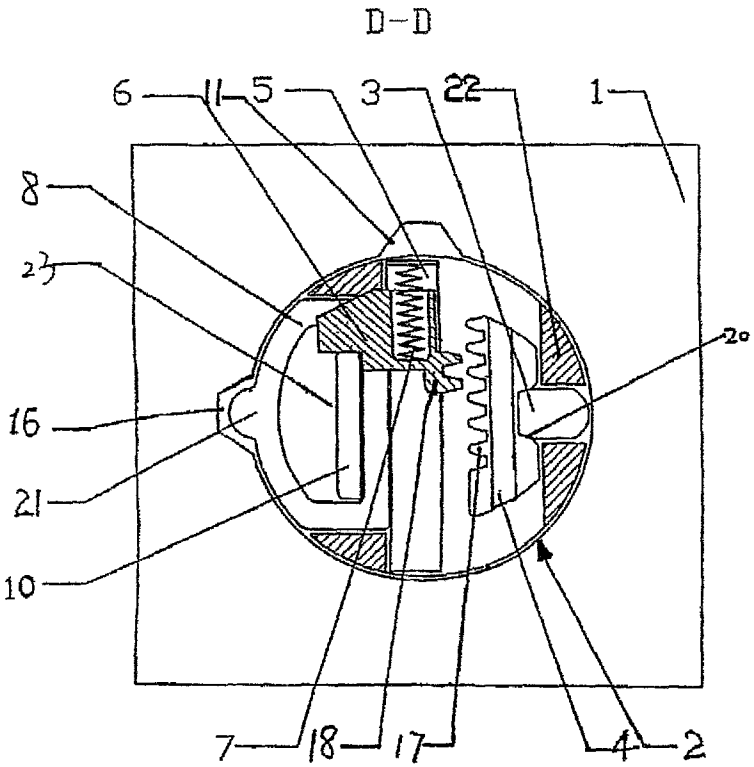
FIG. 7 is the cross-sectional view of the present utility model taken from the line D-D in FIG. 8.
Figure 10:
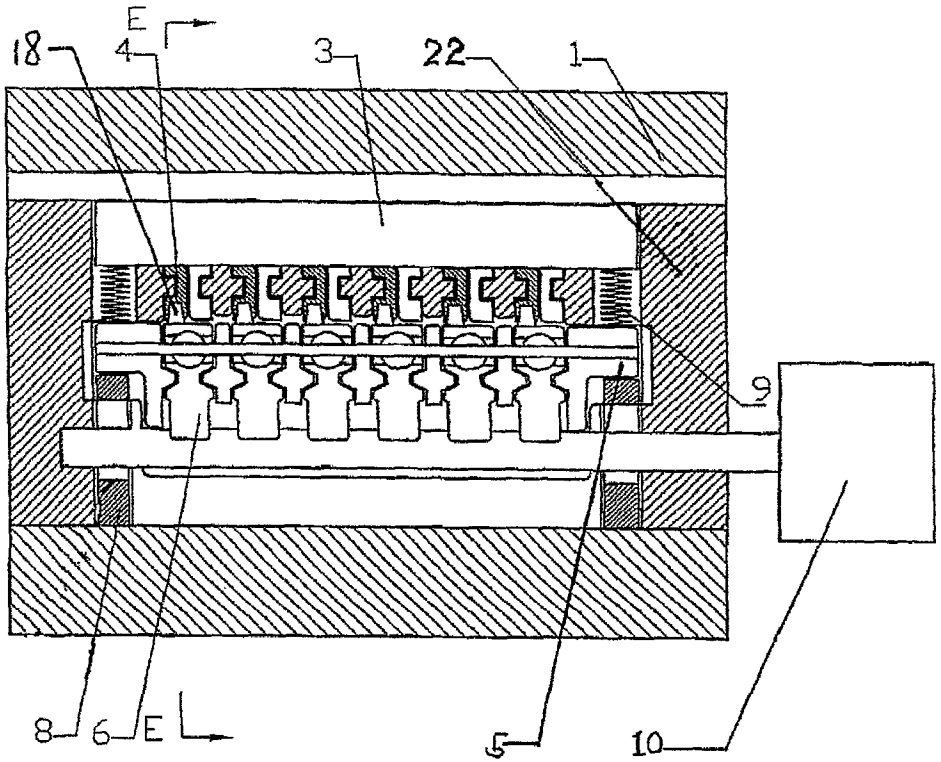
FIG. 10 is the cross-sectional view of the present utility model in the relocked condition after the key changing.
Figure 9:
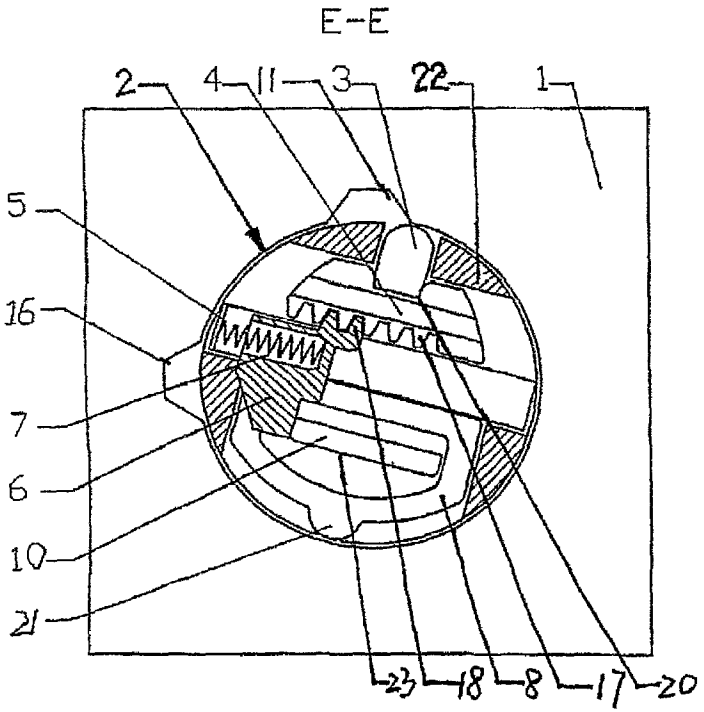
FIG. 9 is the cross-sectional view of the present utility model taken from the line E-E in FIG. 10.

When the lock core 2 is rotated into a proper position, the projection 21 on the unit 8 settles in the cut 16 on the lock shell 1, as shown in the FIGS. 5 and 6. Under the effect of the second spring body 9, the support 5 for sliding blocks pushes the unit 8 linked thereto to moves downwards with it together, the sliding blocks 6 placed on the support 5 for sliding blocks disengages from the engaged tooth pieces 4. Here, the projection 21 on the unit 8 is in the first operating position. When a new key 10 is inserted, the key tooth 12 on the key, cooperating with the first spring body 7, pushes the sliding blocks 6 to reposition the sliding blocks 6 on the tooth pieces 4 so that when the lock core 2 is rotated again to move the projection 21 on the unit 8 out of the cut 16, the projection is in the second operating position where the projection 21 on the unit 8 is positioned against the inner wall of the lock core 2 so that the unit 8, support 5 for sliding blocks and the sliding blocks 6 thereon moves towards the tooth pieces 4 and the sliding blocks 6 reengage with the tooth pieces corresponding to the shape of the new key, as shown in FIGS. 9 and 10. When rotated into a proper position, the key bar 3 is inserted again into the key bar slot 11 of the lock shell 1 under the effect of the first spring body 7, that is, being relocked. At this point, the lock can only be unlocked by the new key and the original key is ineffective.

Figure 12:
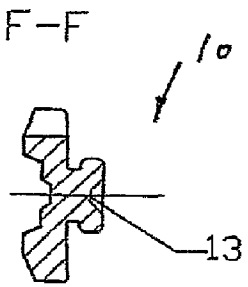
FIG. 12 is the cross-sectional view of the present utility model taken from the line F-F in FIG. 11.
Figure 11:
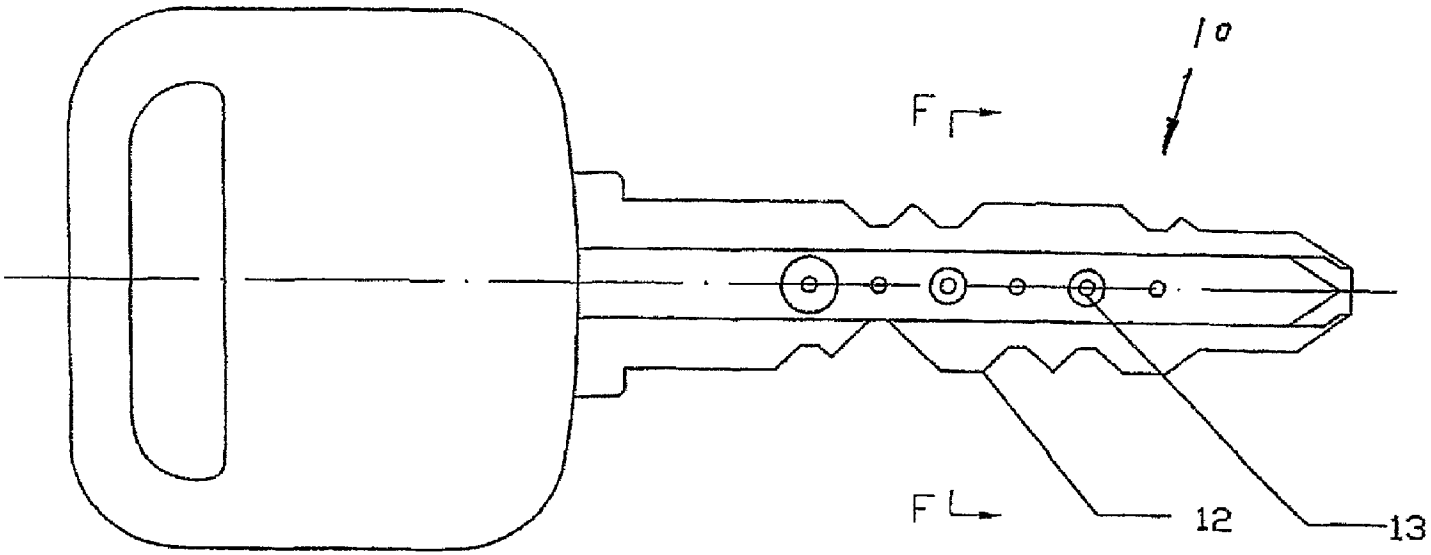
FIG. 11 is the front view of the key of the present utility model.
Figure 13:
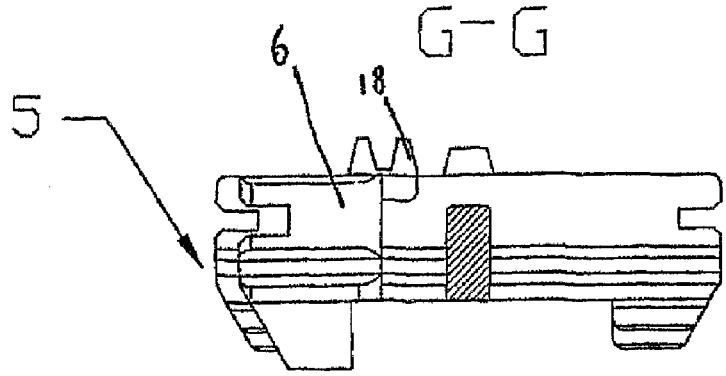
FIG. 13 is the cross-sectional view of the present utility model taken from the line G-G in FIG. 14.
Figure 14:
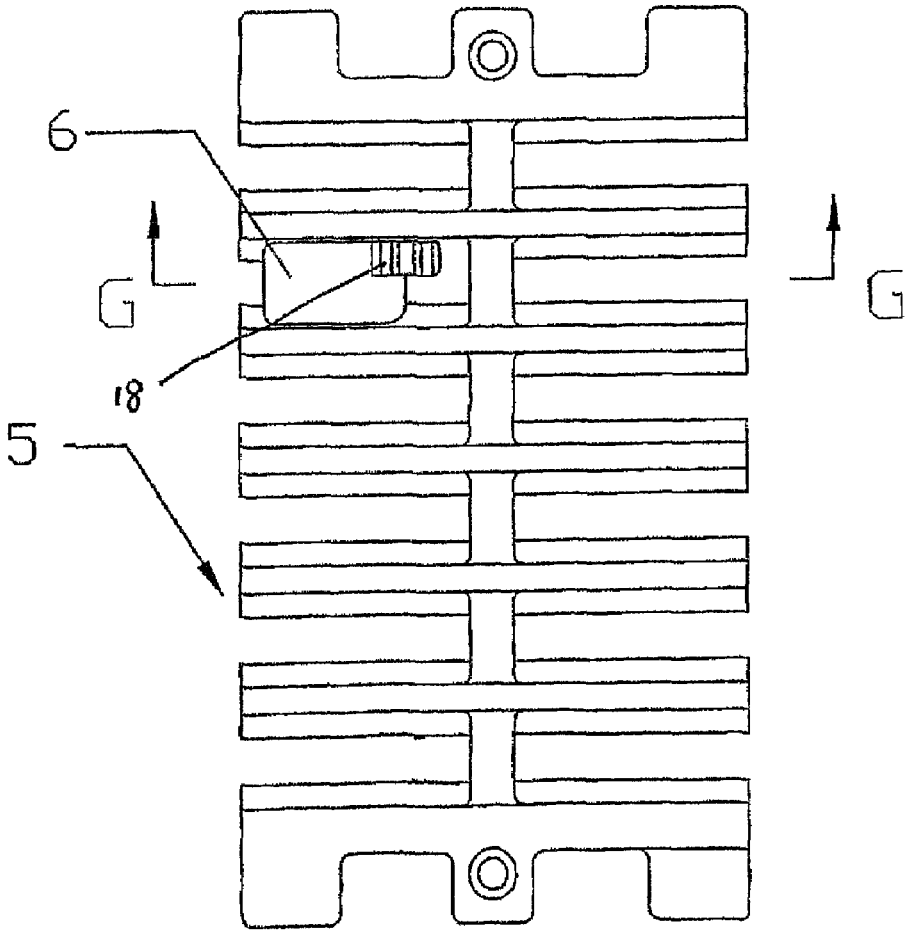
FIG. 14 is the top view of the sliding blocks and the support for sliding blocks according to the present utility model.

With reference to FIGS. 11 and 12, there can also be a plurality of common pins along the horizontal axis of said lock core 2, which corresponds to the pin slot 13 on the side of the key. Therefore there are key teeth 12 on both sides of the key, wherein the position of the key teeth can be as many as 12, and there are pin slots 13 on the side.

Figure 16:
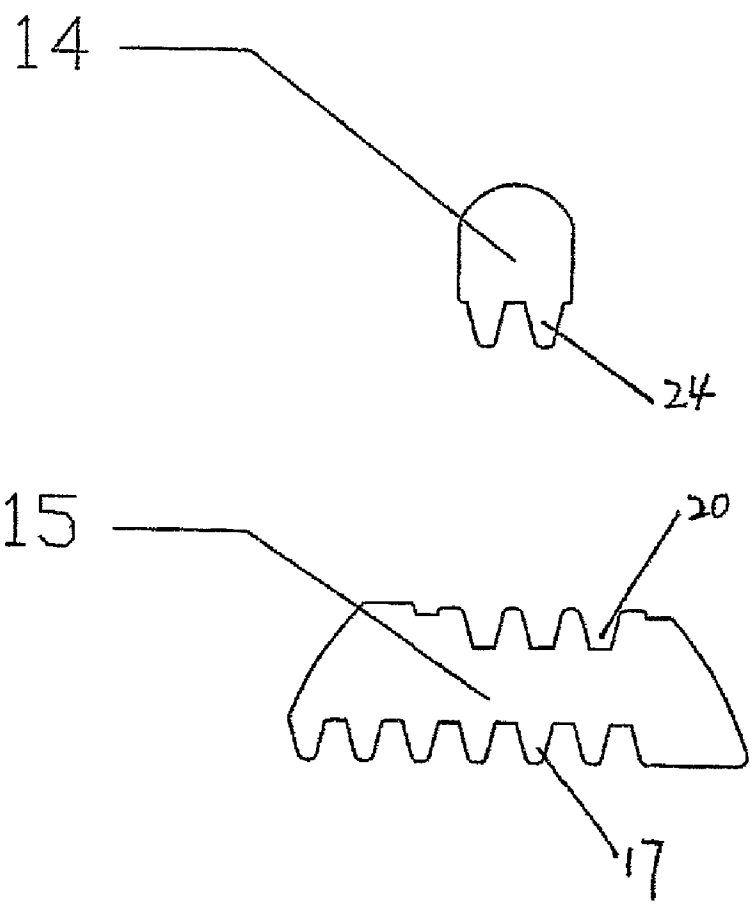
FIG. 16 is the front view of the organized key bar and organized tooth pieces according to the present utility model.
Figure 15:
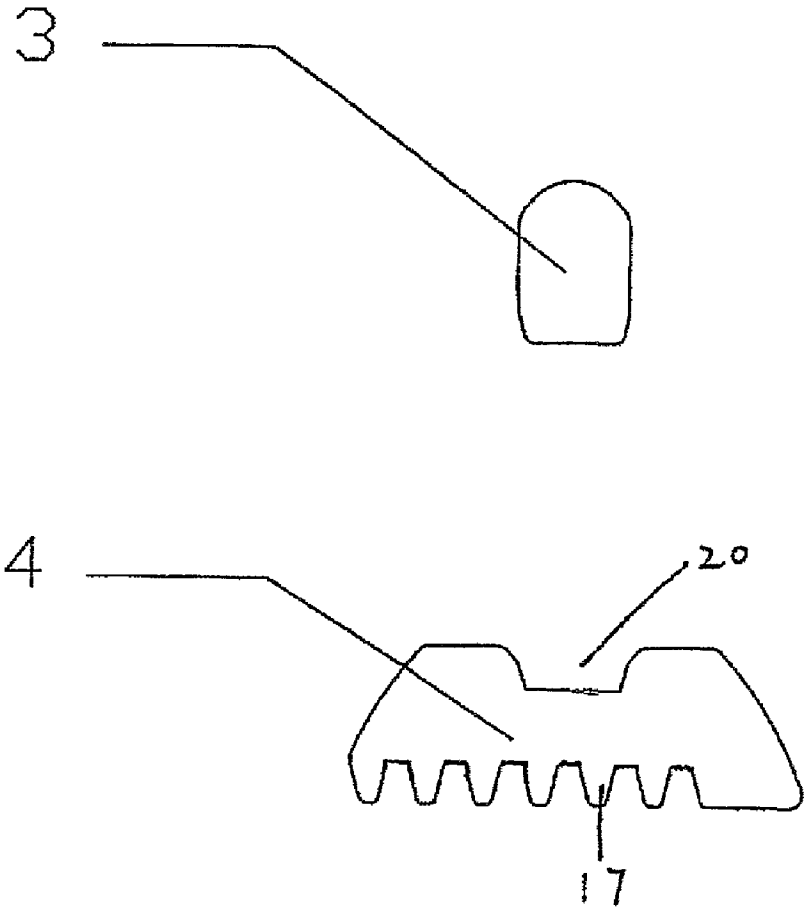
FIG. 15 is the front view of the common key bar and tooth pieces according to the present utility model.
Figure 18:
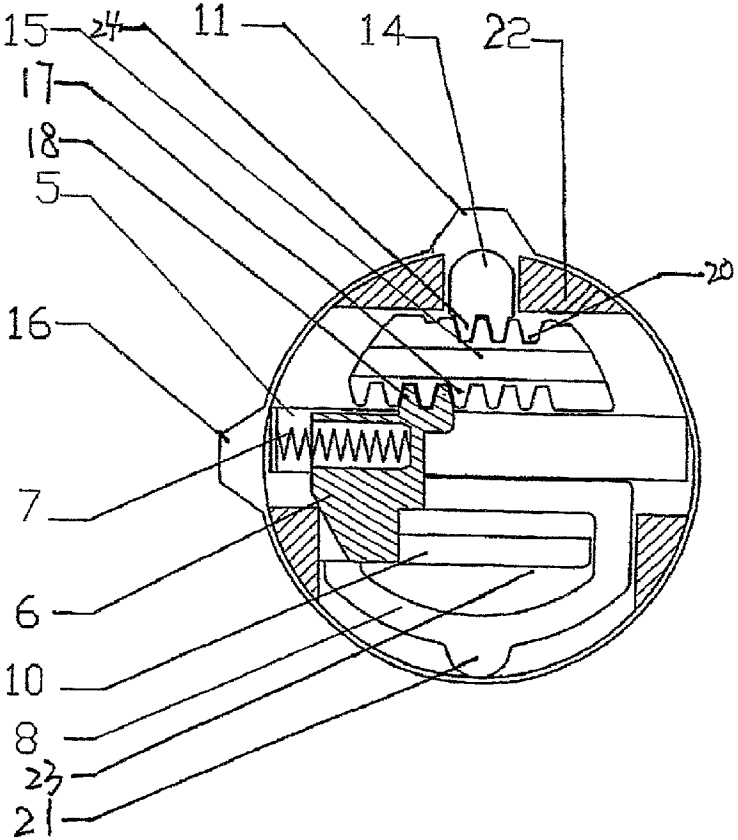
FIG. 18 is the cross-sectional view of the lock core to open the organized lock with the second key according to the present utility model.
Figure 17:
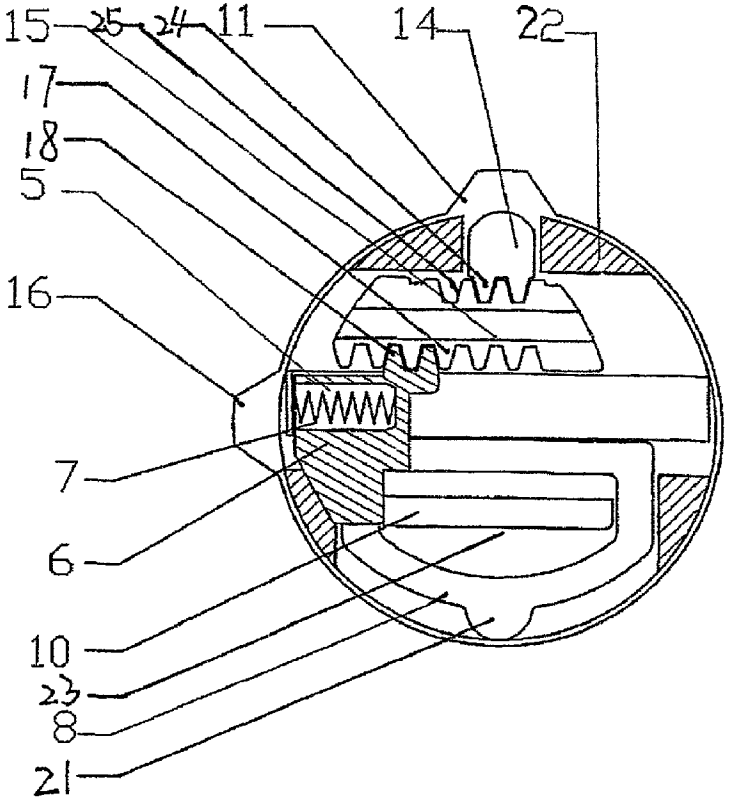
FIG. 17 is the cross-sectional view of the lock core to open the organized lock with the first key according to the present utility model.

Said key bar 3 can also be an organized key bar 14 of at least two teeth-like structures 24 on the side facing the said tooth pieces 4, wherein said tooth pieces 4 can be an organized tooth pieces 15 of at least three recesses 20 on one side, and when the organized key bar 14 is in the second operating position the teeth-like structures 24 on said key bar are inserted into the plurality of recesses 20 on said tooth pieces 4, as shown in FIGS. 15 and 16. Then with such an organized key bar 14, there will be two keys capable of unlocking the lock. FIG. 17 illustrates the case in which the first key unlocks the organized key bar 14 when the organized key bar 14 is settled in the last two teeth-like structures 24 of the organized tooth pieces 15. FIG. 18 illustrates the case in which the second key unlocks the organized lock, when the organized key bar 14 is settled in the first two teeth-like structures 24 of the organized tooth pieces 15 because the key tooth of the second key is lower than that of the first key. Apparently, several tooth pieces 4 in the plurality of sets of tooth pieces and sliding blocks can be changed into organized tooth pieces 15 while the rest of tooth pieces 4 remain unchanged as desired, so that some keys are capable of unlocking more locks while the others can only unlock less locks. In this way, these locks and keys form an organized lock system with management relations due to their different levels.

We claim:

1. A multifunctional lock, comprising a lock shell, and a lock core provided inside the lock shell, wherein said lock core includes the lock core body rotatable with respect to said lock shell, a lock bar provided slidably on said lock core body, a support for sliding blocks provided slidably on said lock core body, a plurality of toothed sliding blocks provided slidably on said support for sliding blocks, and a plurality of tooth pieces provided slidably with respect to the said lock core body, a lock bar slot to receive the said lock bar is opened on said lock shell, each of said tooth pieces is provided with a recess on one side thereof and a plurality of upper teeth extending downwards on the other side, each of said toothed sliding blocks is provided with lower teeth extending upwards, a first elastic element is provided between each of said sliding blocks and its corresponding lock core body, said lock bar has two operating positions, wherein in the first operating position the lock is locked and said lock bar is inserted in said lock bar slot while in the second operating position the lock is unlocked and said lock bar disengages from said lock bar slot and is inserted in the recess on each of the tooth pieces, and wherein a second elastic element is provided between said lock bar and said support for sliding blocks, a unit linked to the support for sliding blocks is provided on one side of the said support for sliding blocks, a keyway is provided in the unit, said sliding blocks at least partially extends into said keyway, said unit has a projection thereon, a cut to receive said projection is provided on said lock shell, when said lock is unlocked said projection has two operating positions, wherein when said projection is in the first operating position said projection is inserted into said cut and said upper teeth disengage from the said lower teeth while when said projection is in the second operating position said projection is out of said cut and said upper teeth engage with the said lower teeth.

2. A multifunctional lock according to claim 1, wherein a guide slope is provided on a side wall of said lock bar slot.

3. A multifunctional lock according to claim 1, wherein a guide slope is provided on a side wall of said cut.

4. A multifunctional lock according to claim 1, wherein two sets of tooth pieces and sliding blocks comprising the tooth pieces, the sliding blocks and the first elastic element are symmetrically provided on said support for sliding blocks respectively with the toothed sliding blocks in the two sets extending from opposite sides of said keyway into the keyway respectively.

5. A multifunctional lock according to claim 1, wherein said cut is located in a position counterclockwise rotated relative to said lock bar slot.

6. A multifunctional lock according to claim 1, wherein said lock bar is of elongated strip shape.

7. A multifunctional lock according to claim 1, wherein said lock bar has teeth-like structure on the side facing said tooth pieces, said tooth pieces has a plurality of recesses on one side thereof, when the lock bar is in the second operating position, the teeth-like structure on said lock bar is inserted into the plurality of recesses on the said tooth pieces.

* * * * *

UNITED STATES PATENT AND TRADEMARK OFFICE

CERTIFICATE OF CORRECTION

PATENT NO. : 7,584,635 B2
APPLICATION NO. : 12/065807
DATED : September 8, 2009
INVENTOR(S) : Gan et al.

It is certified that error appears in the above-identified patent and that said Letters Patent is hereby corrected as shown below:

Column 2,

Line 19, cancel "of the" first occurrence.

Signed and Sealed this

Sixteenth Day of February, 2010

David J. Kappos

David J. Kappos
*Director of the United States Patent and Trademark Office*